United States Patent [19]

Eley

[11] Patent Number: 4,553,915

[45] Date of Patent: Nov. 19, 1985

[54] LOW PRESSURE LUBRICATION SYSTEM FOR FLUID DEVICE

[75] Inventor: James M. Eley, Corinth, Miss.

[73] Assignee: Dana Corporation, Toledo, Ohio

[21] Appl. No.: 689,811

[22] Filed: Jan. 8, 1985

[51] Int. Cl.[4] ..... F04C 29/04

[52] U.S. Cl. ..... 418/102; 418/206

[58] Field of Search ..... 418/102, 132, 131, 133, 418/134, 135, 206; 384/291, 398, 399

[56] References Cited

U.S. PATENT DOCUMENTS

| | | | |
|---|---|---|---|
| 1,271,970 | 7/1918 | Wood | 418/79 |
| 2,276,107 | 3/1942 | Simons | 418/79 |
| 2,775,209 | 12/1956 | Albright | 418/75 |
| 3,076,413 | 2/1963 | Hoffer | 418/102 |
| 4,090,820 | 5/1978 | Teruyama | 418/1 |
| 4,265,602 | 5/1981 | Teruyama | 418/1 |

*Primary Examiner*—Leonard E. Smith
*Assistant Examiner*—Jane E. Obee
*Attorney, Agent, or Firm*—R. H. Johnson

[57] ABSTRACT

There is shown a pressure loaded external gear pump with a low pressure lubrication system. The low pressure lubrication system utilizes the viscous shear pumping effect which occurs between the shafts and bearings to draw fluid from the inlet port, circulate it past the bearings and then return it to the inlet port.

12 Claims, 5 Drawing Figures

LOW PRESSURE LUBRICATION SYSTEM FOR FLUID DEVICE

BACKGROUND OF THE INVENTION

This invention relates to lubrication systems, and more specifically to low pressure lubrication systems for bearings in external gear pumps and motors.

It is common to make use of the fluid being pumped in a gear pump to lubricate the shafts and bearings in the pump. This is accomplished by various lubrication systems which usually include one or more grooves along each bearing, the groove or grooves being connected to fluid at different pressures, for example, inlet and outlet pressure or inlet pressure and pressure at the area where the gear teeth break mesh, in order to provide a fluid flow through the particular system. It is, of course, desirable to have a continuous flow of fluid through any such lubrication system because, among other things, it serves to cool the bearings.

I have learned that not all lubrication systems for gear pumps which connect the bearings to areas of different fluid pressures reliably provide a fluid flow past the bearings. In order to provide a reliable and significant fluid flow past the bearings I provide a lubrication system in which the shafts and bearings function as viscous shear pumps so that fluid is pumped past the bearings. This also has the advantage of providing a fluid flow while permitting the bearings to be connected to a single fluid pressure area, preferably the inlet or low pressure port.

BRIEF SUMMARY OF THE INVENTION

This invention relates to a low pressure lubrication system for external gear pumps and the like in which each shaft bearing is provided with a pair of generally diametrically disposed grooves. Both grooves extend longitudinally partially along the associated bearing, one groove communicating with one end of the bearing and the other groove communicating with the other end of the bearing. The ends of each bearing are in fluid communication with the inlet or low pressure port so that the shaft and associated bearing act as a viscous shear pump to circulate fluid from the inlet port past the bearing and back to the inlet port.

It is a principal object of my invention to provide an improved low pressure lubrication system for external gear pumps and the like which pumps fluid past the bearings.

The above and other objects, features and advantages of my invention will become apparent upon consideration of the detailed description and appended drawing.

DETAILED DESCRIPTION OF THE PREFERRED EMBODIMENT

Figure 1:
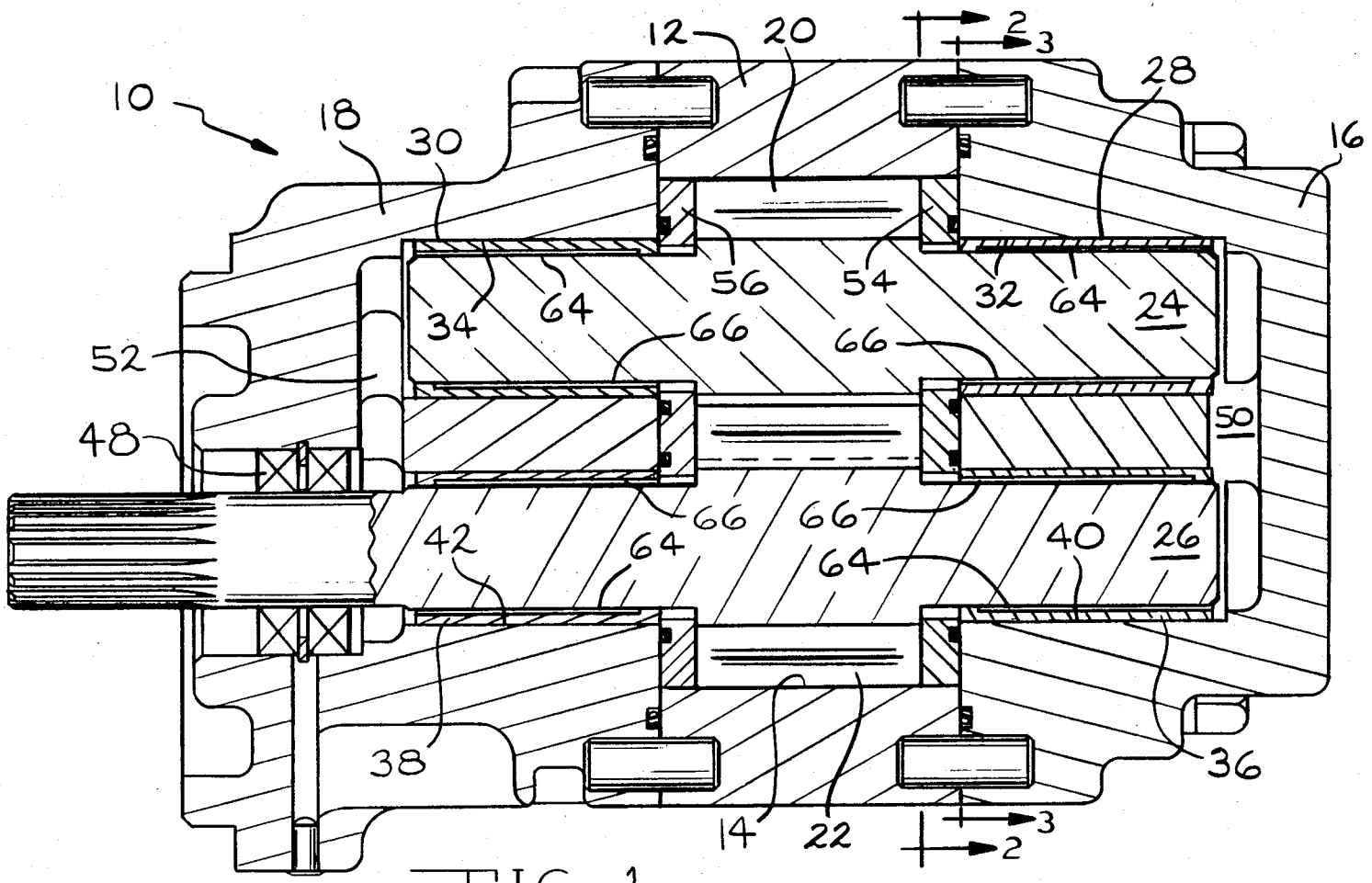
FIG. 1 is a vertical section through an external gear pump embodying my invention.

Referring to FIG. 1, the reference numeral 10 denotes an external gear pump. Pump 10 includes a body 12 with a gear chamber 14 which is enclosed by a rear cover plate 16 and a front cover plate 18, both being fastened to body 12 by any suitable means, such as machine screws. Disposed in gear chamber 14 is a pair of meshing gears 20 and 22 which preferably are formed integrally with shafts 24 and 26, respectively.

Shaft 24 is journaled for rotation in a pair of cylindrical bearings 28 and 30 pressed into bores 32 and 34 in cover plates 16 and 18, respectively. Similarly, shaft 26 is journaled for rotation in a pair of cylindrical bearings 36 and 38 pressed into bores 40 and 42 in cover plates 16 and 18, respectively. Shaft 26 is a drive shaft and extends outwardly through cover plate 18 past a seal assembly 48. A cavity 50 in cover plate 16 connects bores 32 and 40 and a similar cavity 52 connects bores 34 and 42 in cover plate 18.

Figure 2:
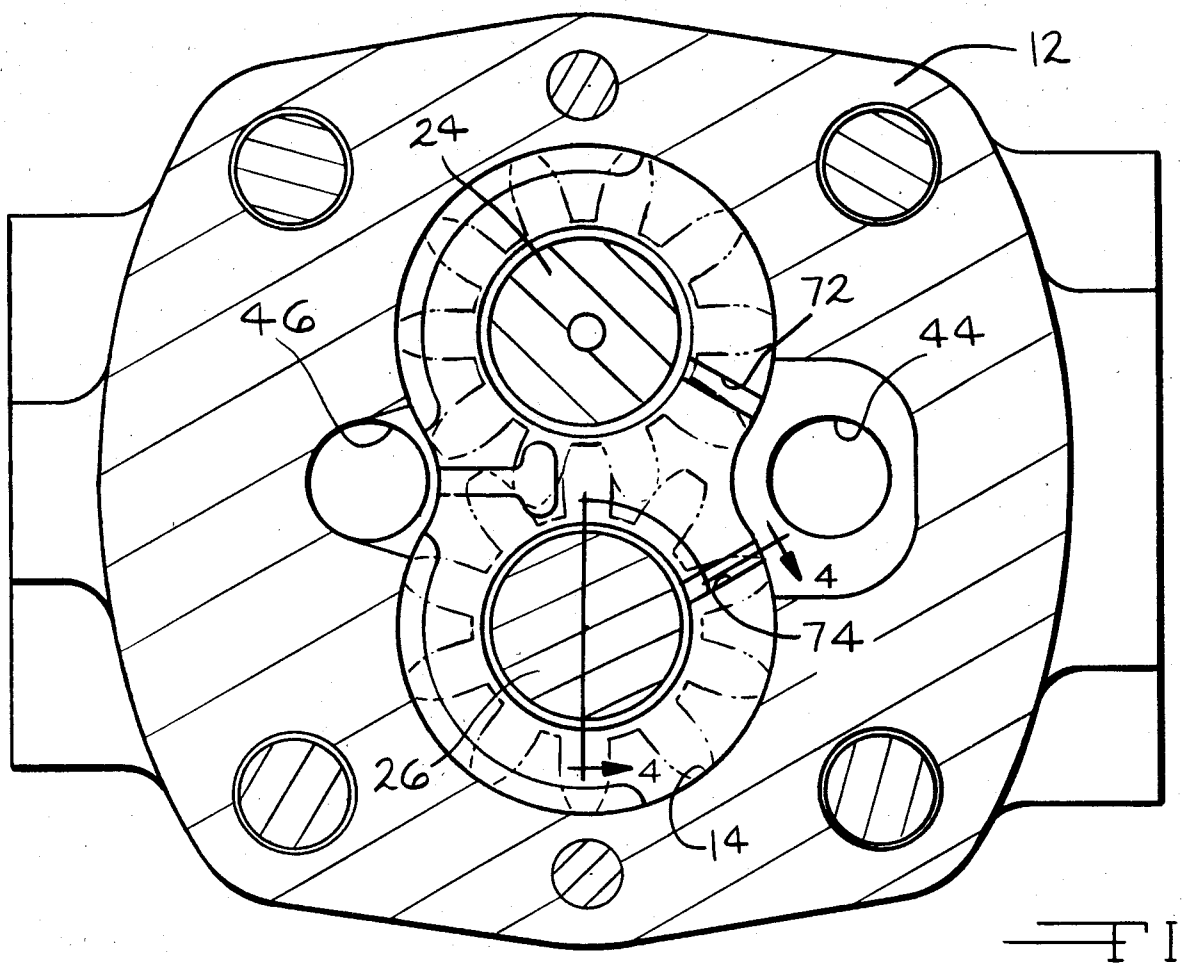
FIG. 2 is a cross-section taken along line 2—2 in FIG. 1.
Figure 3:
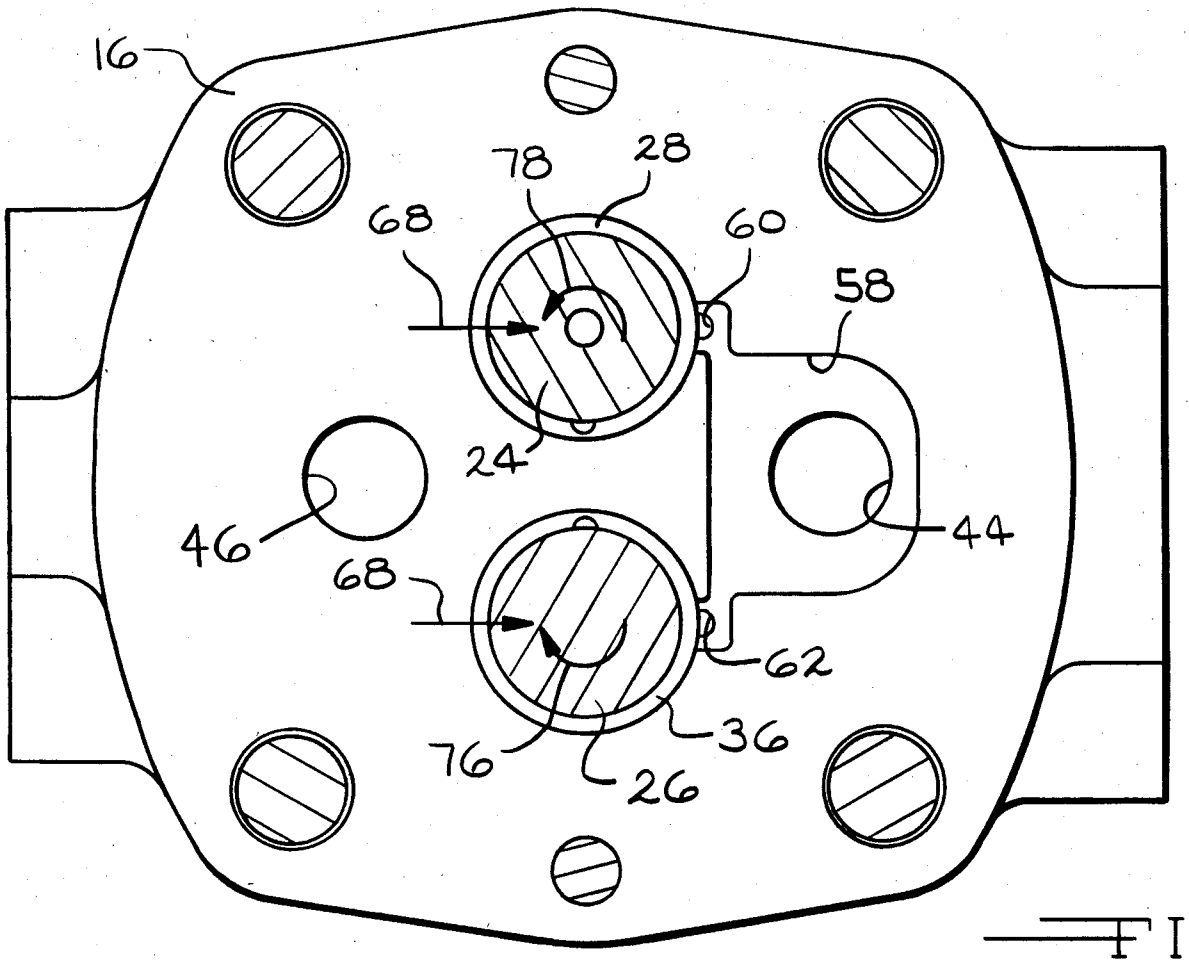
FIG. 3 is a cross-section taken along line 3—3 in FIG. 1.

Referring now also to FIGS. 2 and 3, it will be seen that pump 10 includes an inlet or low pressure port 44 and an outlet or high pressure port 46. Both ports are located in rear cover plate 16 and communicate with gear chamber 14 on opposite sides of meshing gears 20 and 22.

Pump 10 is a pressure loaded pump, and so includes a pair of pressure plates 54 and 56 located in gear chamber 14 on opposite sides of gears 20 and 22. Both pressure plates are arranged to have high pressure fluid communicated to a portion of their surfaces remote from the side faces of gears 20 and 22 so they are biased against the gear side faces in order to provide a highly effective seal between the pressure plate and gear side faces.

Pump 10, as thus far described, is old and well known in the art.

I will now describe my novel low pressure lubrication system for use with pump 10. Insofar as this lubrication system is concerned, the construction of the pump to the right of gears 20 and 22, as viewed in FIG. 1, can be considered to be identical with the construction of the pump to the left side of gears 20 and 22. Therefore, only that portion of the lubrication system located to the right of gears 20 and 22 will be described in detail, but it should be understood that the entire lubrication system includes an arrangement of grooves and fluid passages to the left of gears 20 and 22 which is identical with those which will be described to the right of gears 20 and 22.

Referring now to FIG. 3, there is a recess in the inner surface of cover plate 16 which communicates with inlet port 44 and with a pair of fluid passages 60 and 62 in plate 16. Fluid passages 60 and 62 (see (FIG. 4) in turn communicate with cavity 50 so that fluid passage means is provided between inlet 44 and the outboard ends of bearings 28 and 36.

Figure 5:
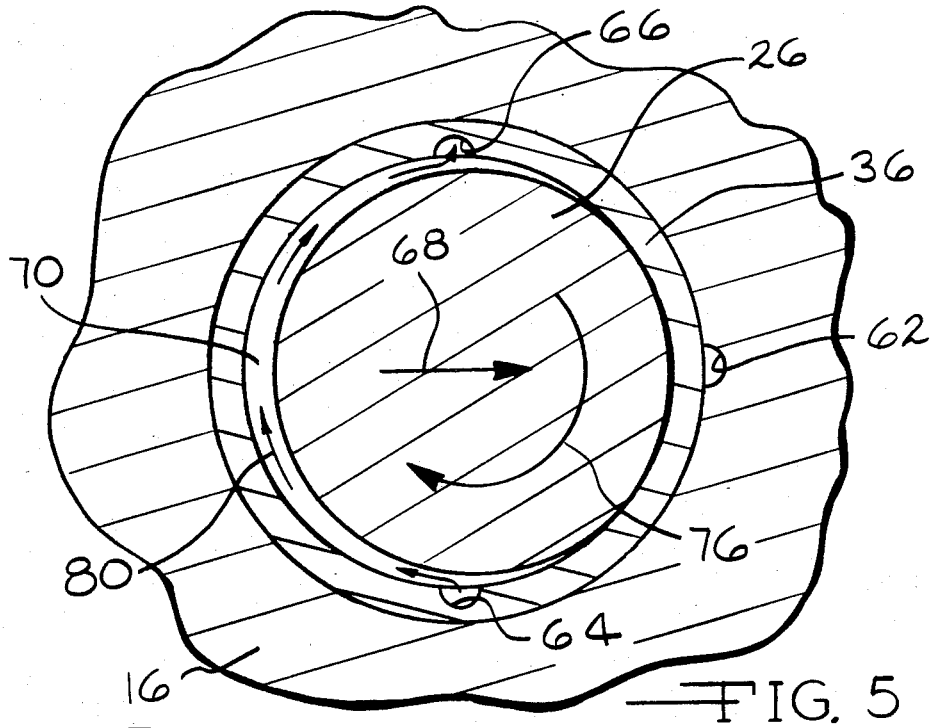
FIG. 5 is a cross-section taken along line 5—5 in FIG. 4.
Figure 4:
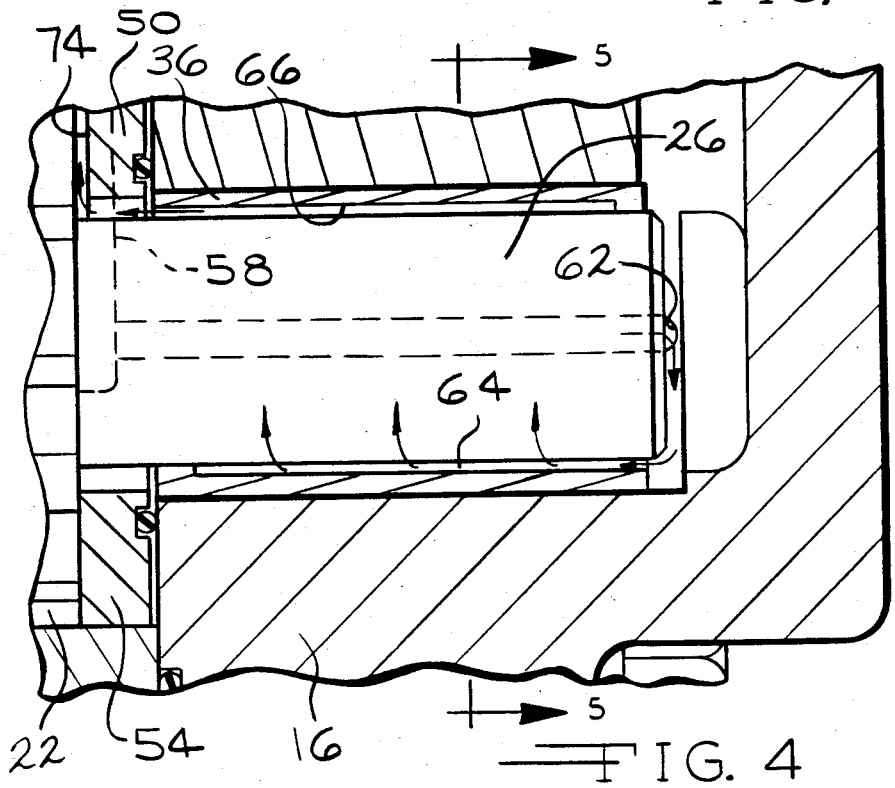
FIG. 4 is an enlarged fragmentary view of a shaft and bearing taken along line 4—4 in FIG. 2.

Referring now alos to FIGS. 1, 4 and 5, all of the bearings are provided with a pair of grooves 64 and 66. Each groove 64 extends longitudinally only partially along the inner diameter of the associated bearing from the outboard end thereof. Similarly, each groove 66 extends longitudinally only partially along the inner diameter of the associated bearing from the inboard end thereof. As is best shown in FIG. 5, grooves 64 and 66 are located substantially diametrically opposite each other and approximately 90° away from the line of force 68 pressing shaft 26 against bearing 36.

Bearing 36 has a running diametrical clearance with shaft 26 of approximately 0.004 inches (0.10 mm). Thus, when pump 10 is in operation so that gears 20 and 22 are being biased apart, line of force 68 will push shaft 26 to the position shown in FIG. 5 so that shaft 26 is running on a very thin film of oil between it and bearing 36. This provides a crescent shaped chamber 70 which at its widest is approximately 0.004 of an inch (0.10 mm) and extends approximately from groove 64 around to groove 66. The importance of chamber 70 will be explained shortly. While only the relationship between shaft 26 and bearing 36 has been explained in this regard, it will be understood that a similar situation exists for all of the bearings and shafts in the pump.

Turning now to FIG. 2, it will be seen that a groove 72 on the inner surface of pressure plate 54 serves to place the inboard end of bearing 28 in fluid communication with inlet port 44. Similarly, a groove 74 serves to place the inboard end of bearing 36 in fluid communication with inlet port 44. Similar grooves in pressure plate 56 serve to place bearings 30 and 38 in fluid communication with inlet port 44 as well.

In describing the operation of my imroved low pressure lubrication system, it will be assumed that shaft 26 is being driven in the direction indicated by arrow 76 which, due to the meshing of gears 20 and 22, will cause shaft 24 to be driven in the direction indicated by arrow 78. As a result fluid will be drawn into pump 10 through inlet port 44 and discharged from pump 10 through outlet port 46.

During operation of pump 10 each shaft and bearing assembly functions as a viscous shear pump. Specifically, referring to FIG. 5, fluid which is in chamber 70 tends to cling to shaft 26, and so is carried along with shaft 26 as it rotates in the direction indicated by arrows 80; however, as the fluid approaches the area of groove 66, chamber 70 decreases substantially in volume so that some of the fluid in chamber 70 is forced out through groove 66. By the same token, the fluid that is being carried along in chamber 70 due to its tendency to cling to shaft 26 is moving away from groove 64 so the fluid that is being pulled away tends to cause a lower pressure at this area with the result that fluid is drawn into chamber 70 through groove 64. As will now be obvious, shaft 26 and bearing 36 act as a viscous shear pump drawing or pulling fluid into chamber 70 through groove 64 and forcing fluid out of chamber 70 through groove 66. Since groove 64 is in fluid communication with inlet 44 through cavity 50, passage 62 and recess 58 and groove 66 is in fluid communication with inlet port through groove 66, there is provided a complete circuit of low pressure lubricating fluid flow from inlet port 44, past bearing 36 and back to inlet port 44.

While the operation of my low pressure lubrication system has been described in detail only for that portion of the system regarding shaft 26 and bearing 36 it should be understood that the same operation and viscous shear pump action occurs for all of the shaft and bearing assemblies in the pump.

While only a single embodiment of my invention has been described, it will be understood that various modifications can be made to my invention without departing from the spirit and scope of it. For example, depending upon manufacturing processes, the various fluid passages communicating the inboard and outboard ends of the bearings with inlet port 44 can be in various locations other than those specifically shown in the preferred embodiment. Therefore, the limits of my invention should be determined from the appended claims when considered in light of the prior art.

I claim:

1. For use in a fluid device having a low pressure port, a shaft, a gear carried by the shaft, and a cylindrical bearing in which said shaft is journaled, a low pressure lubrication system comprising first fluid passage means connecting the end of the bearing remote from the gear with the low pressure port, second fluid passage means connecting the end of the bearing adjacent the gear with the low pressure port, a first groove in the bearing extending partially along the bearing from the remote end thereof and a second groove in the bearing extending partially along the bearing from the adjacent end thereof.

2. A low pressure lubrication system as set forth in claim 1 wherein said grooves extend longitudinally of said bearing and are located approximately diametrically opposite each other.

3. A low pressure lubrication system as set forth in claim 2 wherein said grooves are located approximately 90° away from the line of force pressing the shaft against the bearing.

4. For use in a fluid device having a low pressure port, a pair of meshing gears, each gear being carried by a separate shaft, and a plurality of cylindrical bearings in which the shafts are journaled, the bearings having outboard and inboard ends, a low pressure lubrication system comprising first fluid passage means connecting the outboard ends of the bearings with the low pressure port, second fluid passage means connecting the inboard ends of the bearings with the low pressure port, a first groove in each bearing extending only partially along the respective bearing from the outboard end thereof, and a second groove in each bearing extending only partially along the respective bearing from the inboard end thereof so that the bearings and shafts function as viscous shear pumps to pull fluid from the low pressure port, circulate the fluid through the bearings and return the fluid to the low pressure port.

5. A low pressure lubrication system as set forth in claim 4 wherein the grooves in each bearing extend longitudinally of the bearing and are located approximately diametrically opposite each other.

6. A low pressure lubrication system as set forth in claim 5 wherein said grooves are located approximately 90° away from the line of force pressing the shaft against the associated bearings.

7. A fluid device comprising a low pressure port, a shaft, a gear carried by said shaft, a cylindrical bearing in which said shaft is journaled with a running clearance, first fluid passage means connecting the end of said bearing remote from said gear with said low pressure port, second fluid passage means connecting the end of said bearing adjacent said gear with said low pressure port, a first groove in said bearing extending only partially along said bearing from said remote end, and a second groove in said bearing extending only partially along said bearing from said adjacent end whereby said shaft and bearing function as a viscous shear pump to draw fluid from said low pressure port, circulate said fluid between said shaft and said bearing and return said fluid to said low pressure port.

8. A fluid device as set forth in claim 7 wherein said grooves extend longitudinally of said bearing and are located approximately diametrically opposite each other.

9. A fluid device as set forth in claim 8 wherein said grooves are located approximately 90° away from the line of force pressing said shaft against said bearing.

10. A fluid pump comprising a low pressure port, a pair of external meshing gears which tend to be biased apart by fluid pressure, said gears being carried by separate shafts, each shaft being journaled in a pair of cylindrical bearings having outboard and inboard ends, first fluid passage means connecting the outboard ends of said bearings with said low pressure port, second fluid passage means connecting the inboard ends of said bearings with said low pressure port, a first groove in each bearing extending only partially along each bearing from the outboard end thereof, and a second groove in each bearing extending only partially along each bearing from the inboard end thereof whereby said shafts and said bearings function as viscous shear pumps to draw fluid from said low pressure port, circulate said fluid between said shafts and said bearings and return said fluid to said low pressure port.

11. A fluid pump as set forth in claim 10 wherein the grooves in each bearing extend longitudinally of the bearing and are locacted approximately diameterically opposite each other.

12. A fluid pump as set forth in claim 11 wherein said grooves are located approximately 90° away from the line of force pressing the shaft against the associated bearings.

* * * * *